US006504520B1

(12) United States Patent
Osada et al.

(10) Patent No.: US 6,504,520 B1
(45) Date of Patent: Jan. 7, 2003

(54) ELECTROLUMINESCENT DISPLAY DEVICE HAVING EQUALIZED LUMINANCE

(75) Inventors: Masahiko Osada, Hekinan (JP); Muneaki Matsumoto, Okazaki (JP); Toshinori Ninoyu, Nagoya (JP); Hideki Saito, Chiryu (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/244,736

(22) Filed: Feb. 10, 1999

(30) Foreign Application Priority Data

Mar. 19, 1998 (JP) ..... 10-070698
Oct. 21, 1998 (JP) ..... 10-300031

(51) Int. Cl.[7] ..... G09G 3/30

(52) U.S. Cl. ..... 345/76; 345/77; 345/79; 315/169.3

(58) Field of Search ..... 345/76, 77, 78, 345/79, 80, 81, 45; 315/169.1, 169.3

(56) References Cited

U.S. PATENT DOCUMENTS

| | | | | |
|---|---|---|---|---|
| 4,739,320 A | * | 4/1988 | Dolinar et al. | 345/78 |
| 5,311,169 A | | 5/1994 | Inada et al. | |
| 5,805,124 A | * | 9/1998 | Kapoor et al. | 345/76 |
| 5,815,129 A | * | 9/1998 | Jung | 345/93 |
| 5,856,813 A | * | 1/1999 | Katayama et al. | 345/76 |
| 5,973,456 A | * | 10/1999 | Osada et al. | 315/169.1 |
| 5,990,629 A | * | 11/1999 | Yamada et al. | 315/169.3 |
| 6,008,588 A | * | 12/1999 | Fujii | 315/169.3 |
| 6,091,392 A | * | 7/2000 | Imamura | 345/100 |

FOREIGN PATENT DOCUMENTS

| | | | |
|---|---|---|---|
| EP | 0 344 323 | | 12/1989 |
| JP | 53-87250 | | 8/1978 |
| JP | 1-319092 | | 12/1989 |
| JP | 3-126985 | * | 5/1991 |
| JP | 5-113770 | | 5/1993 |
| JP | 7-325554 | | 12/1995 |

OTHER PUBLICATIONS

Japanese Official Action (Excerpt) from the Japanese Patent Office, dated: Mar. 26, 2002, 4–pages (including 2–pages of English Translation).
Office action dated Aug. 20, 2002 in corresponding Japanese Application No. Hei–10–070698 with translation.

* cited by examiner

*Primary Examiner*—Dennis-Doon Chow
*Assistant Examiner*—Amr Awad
(74) *Attorney, Agent, or Firm*—Harness, Dickey & Pierce, PLC

(57) ABSTRACT

An electroluminescent display panel having a matrix electrode structure composed of scanning electrodes and data electrodes is driven by supplying scanning voltages either alternately or simultaneously from both sides thereof in order to eliminate uneven luminance along a longitudinal direction of the scanning electrodes. Two scanning electrode driving circuits, each connected to each side of the scanning electrodes, may be used. Since an overall luminance of the electroluminescent display panel is a summation of the luminance obtained by scanning the scanning electrodes from one side and the other side, the luminance along the scanning electrodes becomes uniform by scanning from both sides. The data electrodes may be driven from both sides thereof in the same manner as in the scanning electrodes.

1 Claim, 9 Drawing Sheets

ELECTROLUMINESCENT DISPLAY DEVICE HAVING EQUALIZED LUMINANCE

CROSS-REFERENCE TO RELATED APPLICATIONS

This application is based upon and claims benefit of priority of Japanese Patent Applications No. Hei-10-70698 filed on Mar. 19, 1998, and No. Hei-10-300031 filed on Oct. 21, 1998, the contents of which are incorporated herein by reference.

BACKGROUND OF THE INVENTION

1. Field of the Invention

The present invention relates to an electroluminescent display device having a matrix electrode structure, and more particularly to such an electroluminescent display device in which an uneven luminance caused by an electrode resistance is substantially eliminated.

2. Description of Related Art

Generally, an electroluminescent display device (hereinafter referred to as an EL display device) includes an EL panel having scanning electrodes and data electrodes, both electrodes being arranged to form a matrix, a luminescent layer disposed between both electrodes, and driving circuits for driving both electrodes. Pixels are formed at each intersection of both electrodes. The scanning electrodes are sequentially scanned, and at the same time modulation voltages are imposed on the data electrodes. Images are displayed on the EL panel by the pixels arranged in a form of a matrix.

The scanning electrodes are usually made of a metallic material and the data electrodes are made of a transparent material such as ITO. Since the transparent material such as ITO has an electric resistance which is more than ten times (e.g., 10–1000 times) higher than that of a metallic material such as aluminum or chromium, uniformity of display luminance is adversely affected by the electric resistance, and an uneven luminance appears on the display. In order to cope with this problem, a display device disclosed in U.S. Pat. No. 5,311,169 employs a special control of data voltages. That is, a pulse width of the modulation voltage imposed on the data electrodes is increased or decreased according to a scanning sequence of the scanning electrodes. However, this control method is complex and requires an expensive control device. Display devices using a transparent material for both scanning and data electrodes are also proposed. However, no effective solution against the uneven luminance in such a device has been proposed. The uneven luminance problem is especially notable when images are displayed with a lower luminance by decreasing the pulse width of scanning or data voltages.

There are some EL devices in which the scanning electrodes are made of the transparent material such as ITO. In the device of this kind, a scanning voltage pulse is gradually deformed as a distance from an end from which the scanning voltages are imposed increases because of the electric resistance of the transparent electrodes. As a result, the luminance of the display becomes uneven across the display panel. To solve this problem, EP 344323 proposes to impose the scanning voltages from both ends of the scanning electrodes at the same time. Two separate scanning electrode driving circuits are disposed at both sides of the scanning electrodes. However, an excessive current may flow through the scanning electrodes if phases of the pulse voltages imposed from both sides are different from each other. That is, if rising and falling edges of the pulse voltages imposed from both sides do not appear at the same time, two driving circuits are short-circuited.

SUMMARY OF THE INVENTION

The present invention has been made in view of the above-mentioned problems, and an object of the present invention is to provide an EL display device having transparent electrodes that have a relatively high electric resistance, in which images are displayed with a high luminance uniformity, and more particularly to realize such a display device with a less complex control.

An electroluminescent (EL) display device is composed of a display panel and driving circuits for driving the display panel. In the display panel, an electroluminescent layer is sandwiched between scanning electrodes and data electrodes, both electrodes forming a matrix structure. The driving circuits include a first and a second scanning electrode driving circuit and a data electrode driving circuit. The first scanning electrode driving circuit is connected to one side of the scanning electrodes, while the second scanning electrode driving circuit is connected to the other side of the scanning electrodes. Scanning pulse voltages are supplied to the scanning electrodes alternately from both sides, so that when the first scanning electrode driving circuit supplies the scanning voltage, the second circuit does not operate, and vice versa.

Generally, the luminance of the EL panel is higher at a side where the driving voltage is supplied and lower at the other side because of electric resistance of the scanning electrodes. According to the present invention, the scanning voltages are supplied alternately from both sides, and an overall luminance of the EL panel is a combined luminance obtained by scanning the scanning electrodes from both sides. Therefore, the overall luminance becomes substantially uniform on the surface of the EL panel.

Alternatively, the scanning voltages may be supplied simultaneously from both sides of the scanning electrodes. In this case, the phase of the scanning voltages supplied from both sides has to be equalized. If the scanning voltages are supplied from both sides at different timing or with different phases, excessive current flows through the scanning electrodes, and the first and second scanning electrode driving circuits would be short-circuited in the worst case. According to the present invention, output stages of the scanning electrode driving circuits are brought into a high impedance state for predetermined periods before and after the scanning voltage is supplied, in order to surely avoid such an excessive current or short-circuit. The uniformity of the luminance is attained by supplying the scanning voltages simultaneously from both sides.

The data electrodes may be driven from both sides thereof either alternately or simultaneously, if it is required to eliminate uneven luminance along the data electrodes. Further, the scanning electrode driving circuits connected to both sides of the scanning electrodes may be unified into a single driving circuit which supplies the scanning voltages from both sides of the scanning electrodes. To drive the electrodes alternately from both sides by the single driving circuit, its outputs are alternately switched from one side to the other side. This invention may be applied also to a liquid crystal display device having a matrix electrode structure.

Other objects and features of the present invention will become more readily apparent from a better understanding of the preferred embodiments described below with reference to the following drawings.

DETAILED DESCRIPTION OF THE PREFERRED EMBODIMENTS

Figure 1:
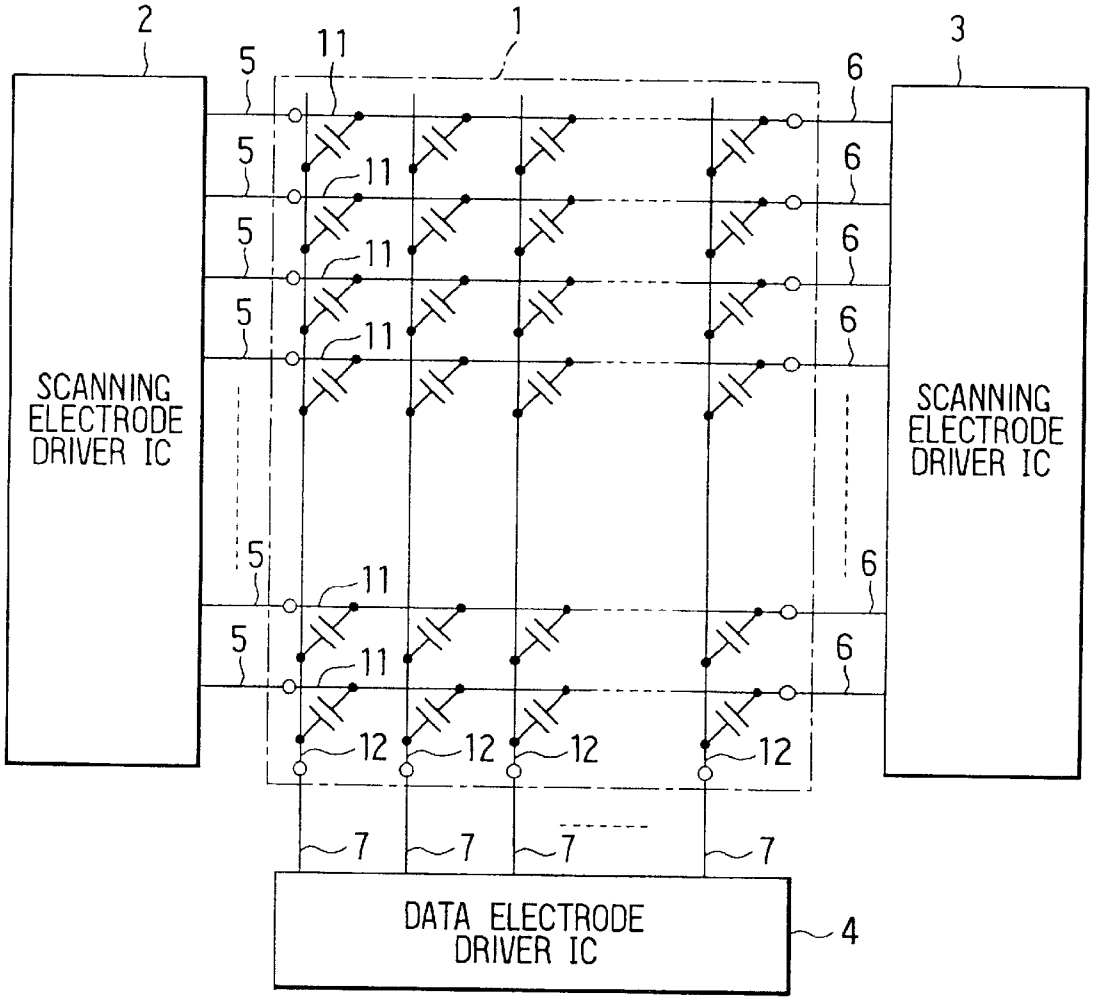
FIG. 1 is a block diagram showing a whole structure of an EL display device as a first embodiment according to the present invention.

A first embodiment of the present invention will be described, referring to FIGS. 1–8. FIG. 1 shows a whole structure of the first embodiment. An EL panel 1 includes plural scanning electrodes 11 formed on a substrate, plural data electrodes 12 formed on the other substrate and an electroluminescent (EL) layer interposed between both electrodes 11, 12. The scanning electrodes 11 and the data electrodes 12 are arranged to form a matrix, and EL pixels are formed at each intersection of both electrodes. Since the EL pixels are capacitive elements, they are shown in FIG. 1 with capacitor symbols. The scanning electrodes 11 and the data electrodes 12 are made of a transparent material such as ITO. A scanning electrode driver IC 2 which constitutes a scanning electrode driving circuit is connected to the left ends of the scanning electrodes 11 through metal connecting wires 5 made of Cu or the like. A scanning electrode driver IC 3 which constitutes another scanning electrode driving circuit is connected to the right ends of the scanning electrodes 11 through metal wires 6 made of Cu or the like. A data electrode driver IC 4 which constitutes a data electrode driving circuit is connected to ends of the data electrodes 12 through metal connecting wires 7 made of Cu or the like.

A scanning voltage in a form of a pulse is sequentially applied to the scanning electrodes 11 to scan the same. A modulation voltage which is a data voltage for an image to be shown is applied to the data electrodes 12. The image is displayed on the EL panel 1 by combination of scanning and data voltages. In this embodiment, the scanning electrodes 11 are scanned by the driver IC 2 with a positive voltage in a first field, and with a negative voltage in a second field. Then, the scanning electrodes 11 are scanned by the driver IC 3 with a positive voltage in a third field, and with a negative field in a fourth field. The four fields from first to fourth constitute one cycle, and the scanning operation is performed with more than 60 cycles per second, so that no flicker is recognized by a viewer. In other words, the scanning electrodes 11 are scanned alternately by the left side driver and the right side driver.

Figure 2:
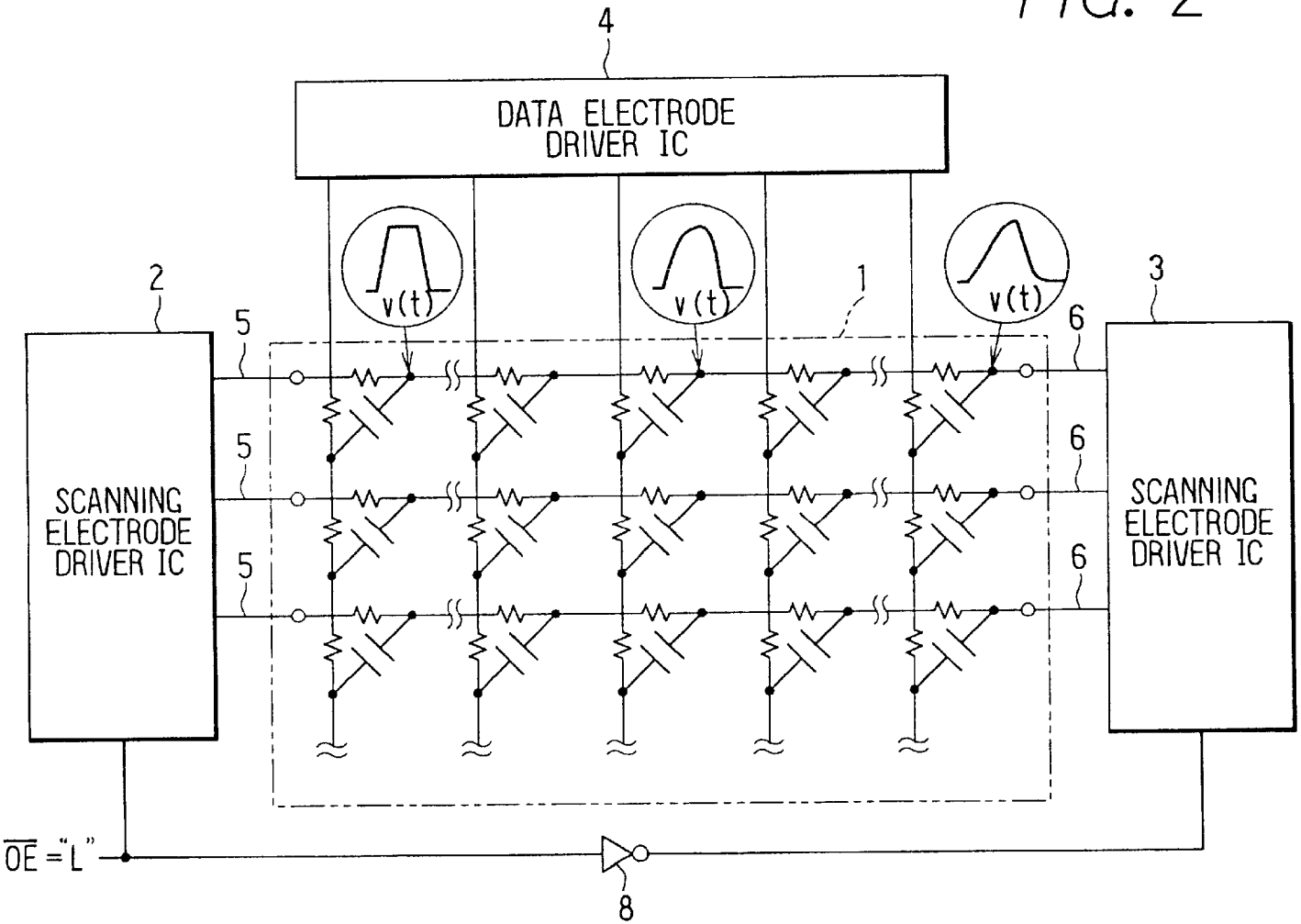
FIG. 2 is a block diagram showing wave forms of a scanning voltage imposed from a left side scanning electrode driving circuit in a positive field.

The scanning operation in the first, second, third and fourth fields will be described, referring to FIGS. 2–5, respectively. FIG. 2 shows waveform deformation in the first field in which the scanning electrodes 11 are scanned by the driver IC 2 with a positive scanning pulse voltage. Which driver IC 2 or 3 performs the scanning is determined by a level (H or L) of an enabling signal $\overline{OE}$ (a negative logic signal of OE). In the first field, the level of $\overline{OE}$ is L (low), and the scanning voltage is sequentially supplied from the driver IC 2 to each scanning electrode from the top to the bottom. Since the level of $\overline{OE}$ signal is inverted by an inverter 8, its level connected to the driver IC 3 is H in the first field in which the driver IC 3 does not supply the scanning voltage. The scanning electrodes 11 are made of a transparent material having a relatively high resistance (more than ten times higher than that of the connecting wires 5, 6). Therefore, the pulse waveform supplied from the left side is gradually deformed as it proceeds to the right side as shown in FIG. 2. According to the deformation of the waveform, current supplied to pixels decreases, thereby decreasing the luminance of the pixels.

Figure 3:
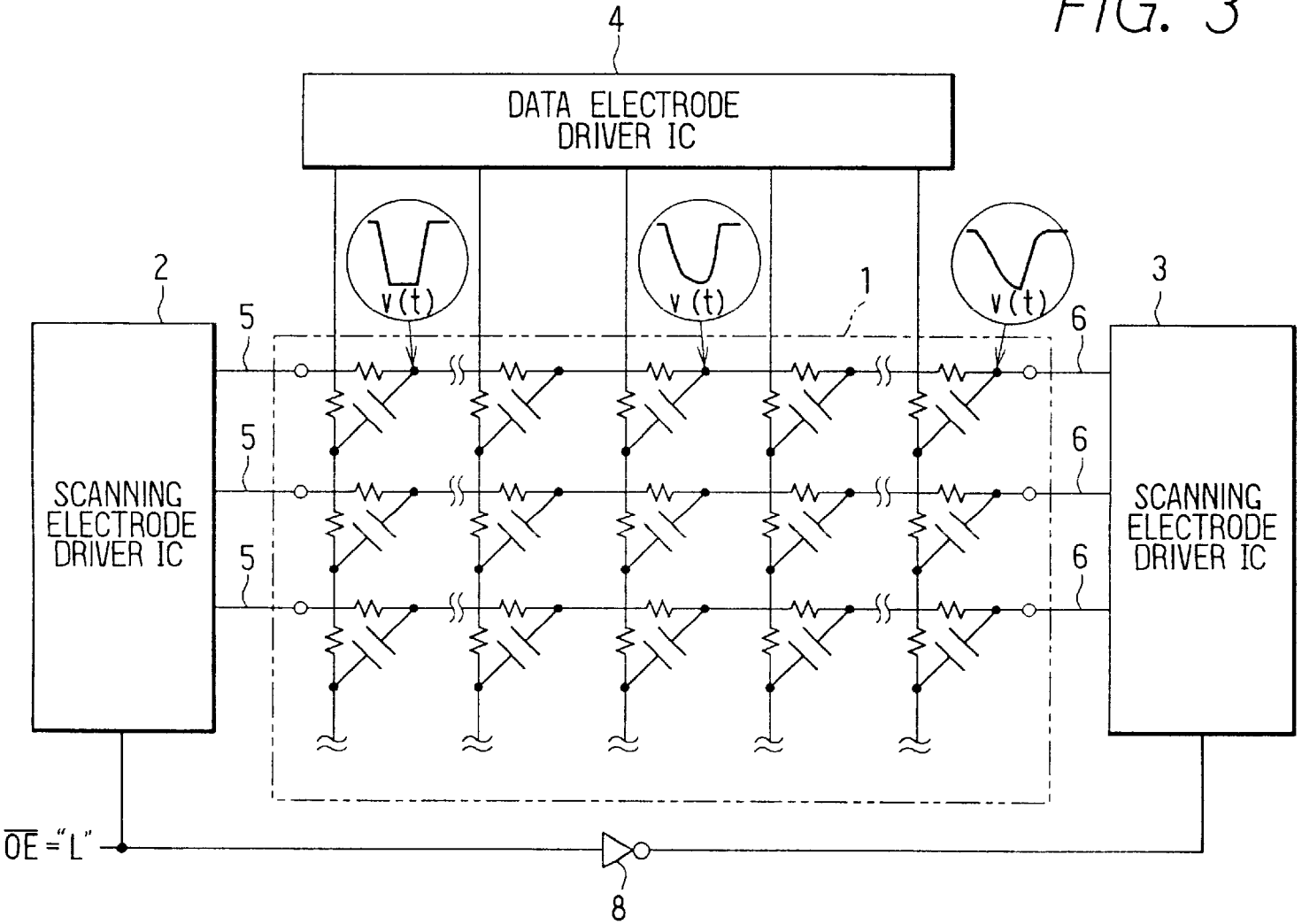
FIG. 3 is a block diagram showing waveforms of a scanning voltage imposed from a left side scanning electrode driving circuit in a negative field.
Figure 4:
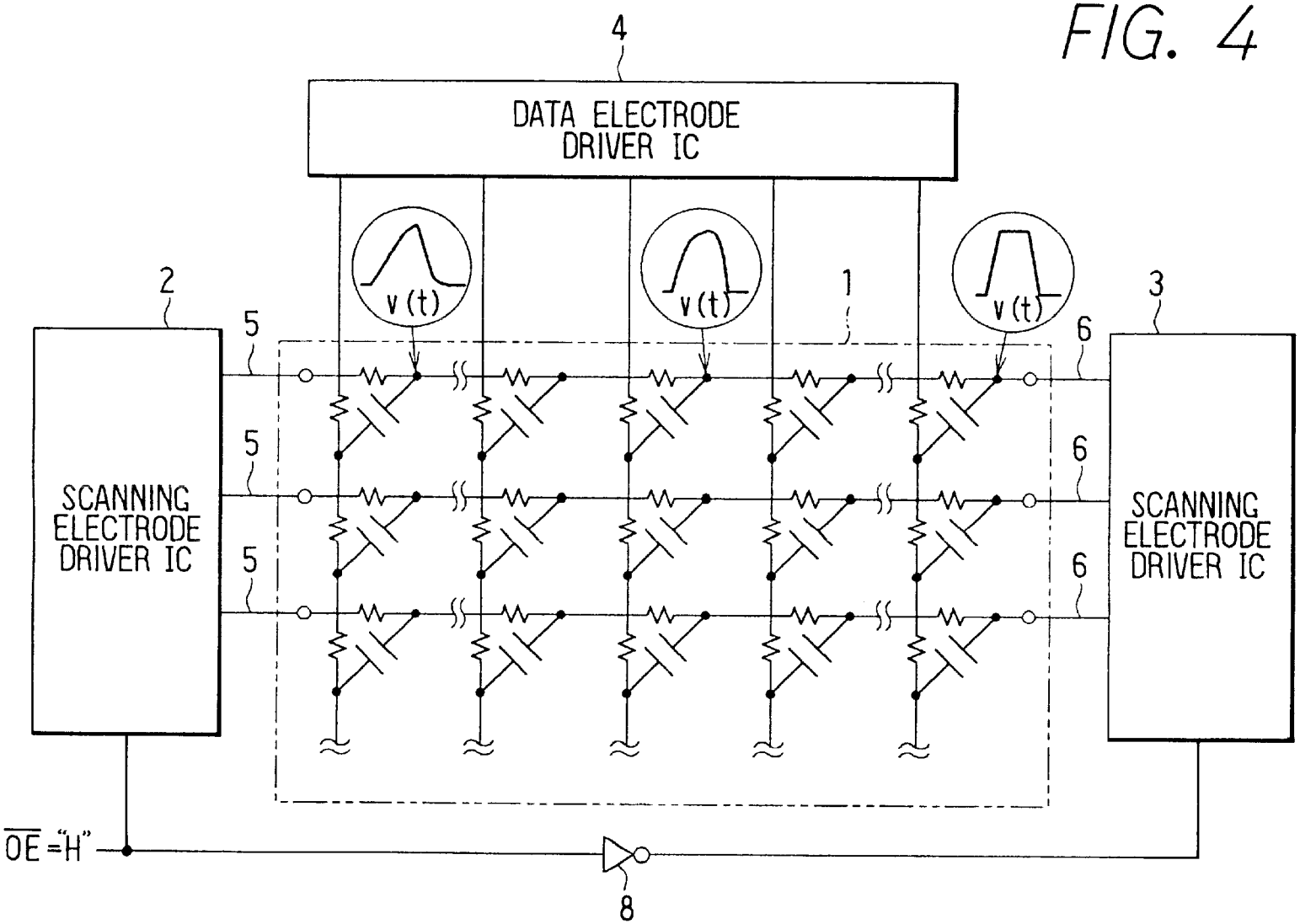
FIG. 4 is a block diagram showing waveforms of a scanning voltage imposed from a right side scanning electrode driving circuit in a positive field.
Figure 5:
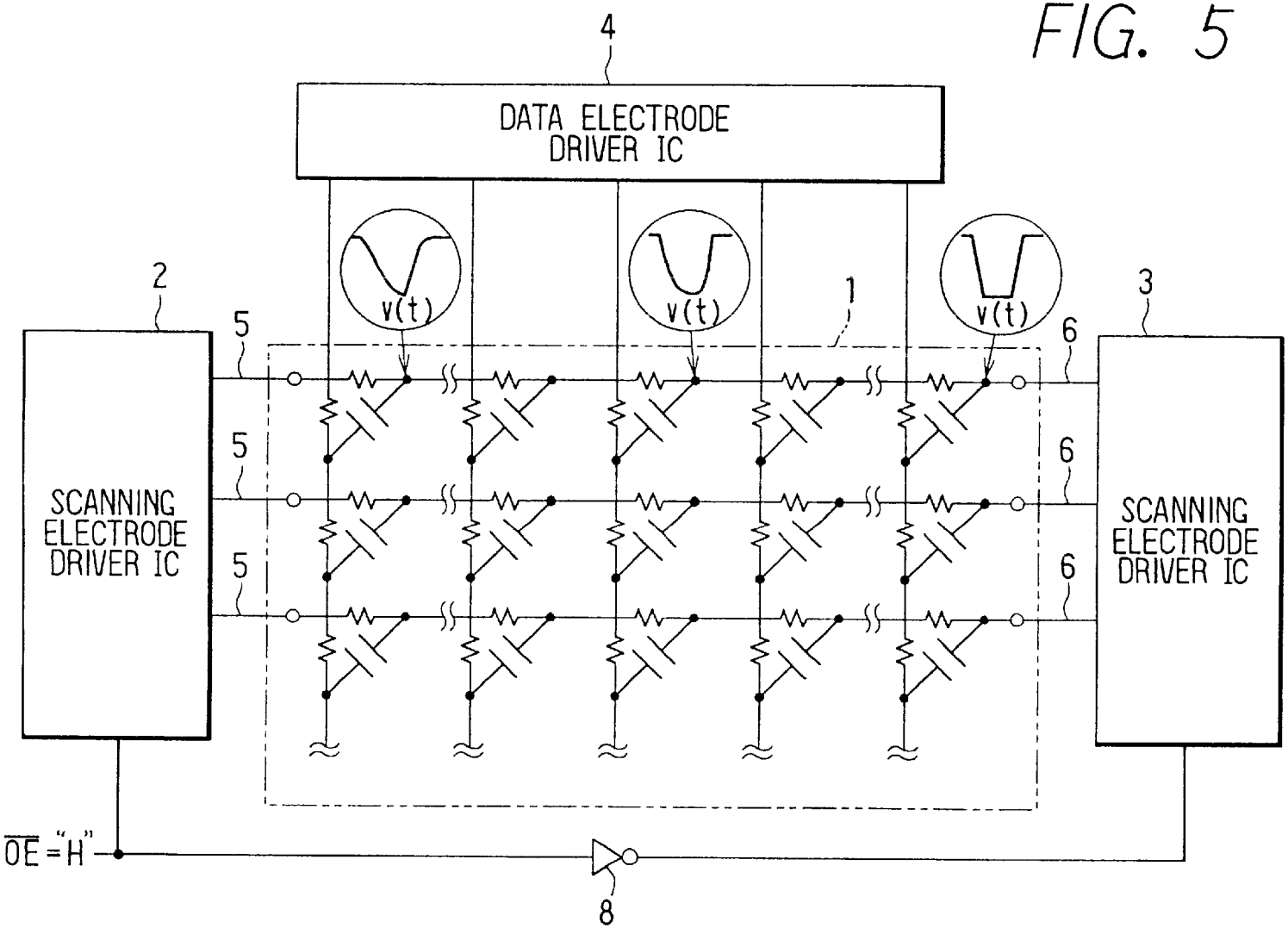
FIG. 5 is a block diagram showing waveforms of a scanning voltage imposed from a right side scanning electrode driving circuit in a negative field.

In the second field shown in FIG. 3, the $\overline{OE}$ signal at L level, while the polarity of the scanning voltage is switched from positive to negative. The waveform of the pulse supplied from the driver IC 2 is gradually deformed as it proceeds to the right side, as shown in FIG. 3. Due to the waveform deformation, the luminance of the EL panel decreases gradually as the position on the panel comes closer to the right side. After the scanning operation in the second field is completed, the $\overline{OE}$ signal turns from L to H, and the scanning operation in the third field shown in FIG. 4 is performed. In the third field, the positive scanning pulse voltage is supplied from the driver IC 3 connected to the right side of the scanning electrodes 11. After the third field scanning is completed, the scanning operation is performed in the fourth field shown in FIG. 5. In the fourth field, the negative scanning pulse voltage is supplied from the driver IC 3 connected to the right side of the scanning electrodes. The waveform of the scanning pulse voltage both in the third and fourth fields is also deformed, and the luminance decreases as the position of the panel becomes apart form the right side, in the same manner as in the first and second fields.

Figure 6:
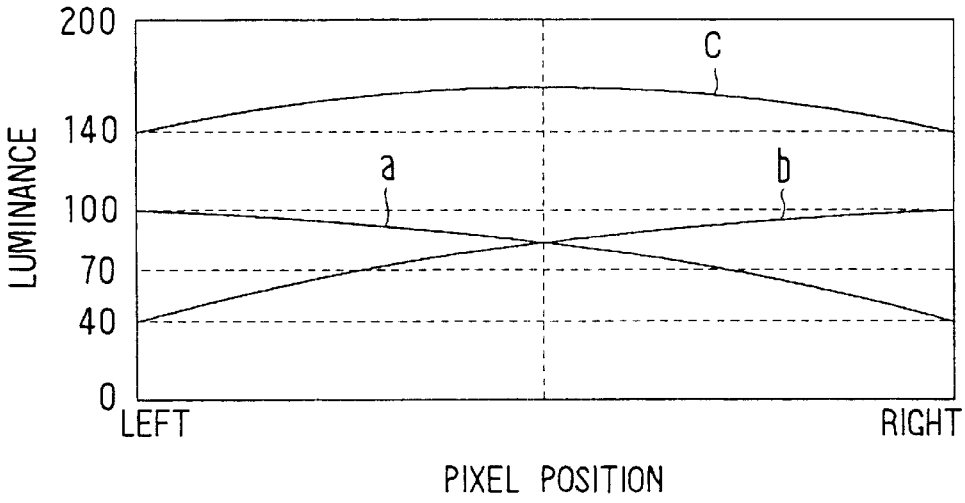
FIG. 6 is a graph showing luminance of the EL panel at various positions thereon.

The level of luminance which varies according to the position on the EL panel is shown in FIG. 6. In FIG. 6, the position on the EL panel from the left side to the right side is shown on the abscissa, and the corresponding luminance is shown on the ordinate. The luminance in the first and second fields in which the scanning voltage is supplied from the driver IC 2 (left side) is shown with a curve "a", while the luminance in the third and fourth fields in which the scanning voltage is supplied from the driver IC 3 (right side) is shown with a curve "b." As the EL panel is scanned with a frequency of more than 60 cycles, one cycle being constituted by four fields (the first–the fourth fields), an overall luminance is a sum of both curves "a" and "b." The overall luminance is shown with a curve "c" in FIG. 6. The luminance decrease at both sides of the EL panel is compensated by scanning the EL panel alternately from both sides.

Figure 7:
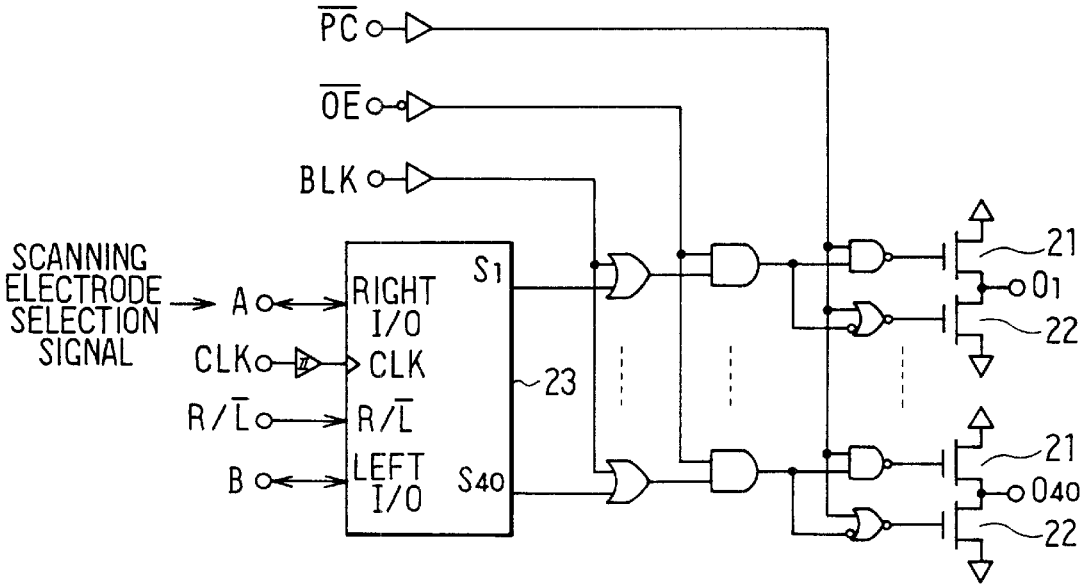
FIG. 7 is a block diagram showing a structure of the scanning electrode driving circuit.

A structure of the driver ICs 2, 3, both having the same structure, will be briefly described referring to FIG. 7. The driver ICs 2, 3 are those sold in the market under the name of $\mu$PD16302. As shown in FIG. 7, the IC driver includes a shift register 23 having 40 terminals S1–S40 and 40 output stages for supplying the scanning pulse voltages to 40 output terminals 01–040. Each output stage is composed of a P channel FET 21 and an N channel FET 22. The output becomes a high level when the P channel FET 21 is turned on, it becomes a low level when the N channel FET 22 is turned on, and it becomes a high impedance state when both FETs are turned off. The shift register 23 sequentially shifts, in accordance with a clock signal CLK, a scanning electrode selection pulse signal (its frequency corresponds to a horizontal synchronizing signal) supplied from an input terminal "A," when an R/$\overline{L}$ terminal is a high level. Thus, the scanning electrode selection pulse signal is sequentially delivered from the terminals S1–S40. As many driver ICs as required according to the number of scanning electrodes 11 can be connected in series by connecting a terminal "B" of one driver IC to an input terminal "A" of another driver IC. A blanking signal BLK is always kept at a low level in this embodiment, and a $\overline{PC}$ signal is used as a signal to select either the P channel FET 21 or the N channel FET 22.

The operation of the driver ICs 2, 3 will be explained, referring to FIG. 8. When the scanning electrode selection pulse signal is fed to the shift register 23, the pulse signal is sequentially shifted and delivered from the terminals S1–S40. During a period in which the selection pulse signal is delivered, an ON-period of the P channel FET 21 and an ON-period of the N channel FET 22 are switched according to switching of H and L level of the $\overline{PC}$ signal, and thereby outputs are supplied from the output terminals "O" (O1, bx;1O2 . . . ). During a period in which the level of the $\overline{OE}$ signal is low (L), the scanning voltages are supplied from the left side driver IC 2 (as shown in the left half of FIG. 8), while the scanning voltages are supplied from the right side driver IC 3 during a period in which the level of the $\overline{OE}$ signal is H (as shown in the right half of FIG. 8). Though FIG. 8 shows the operation in the positive field, the operation in the negative field is performed in the same manner, except that the levels (H and L) of the $\overline{PC}$ signal are reversed.

Figure 8:
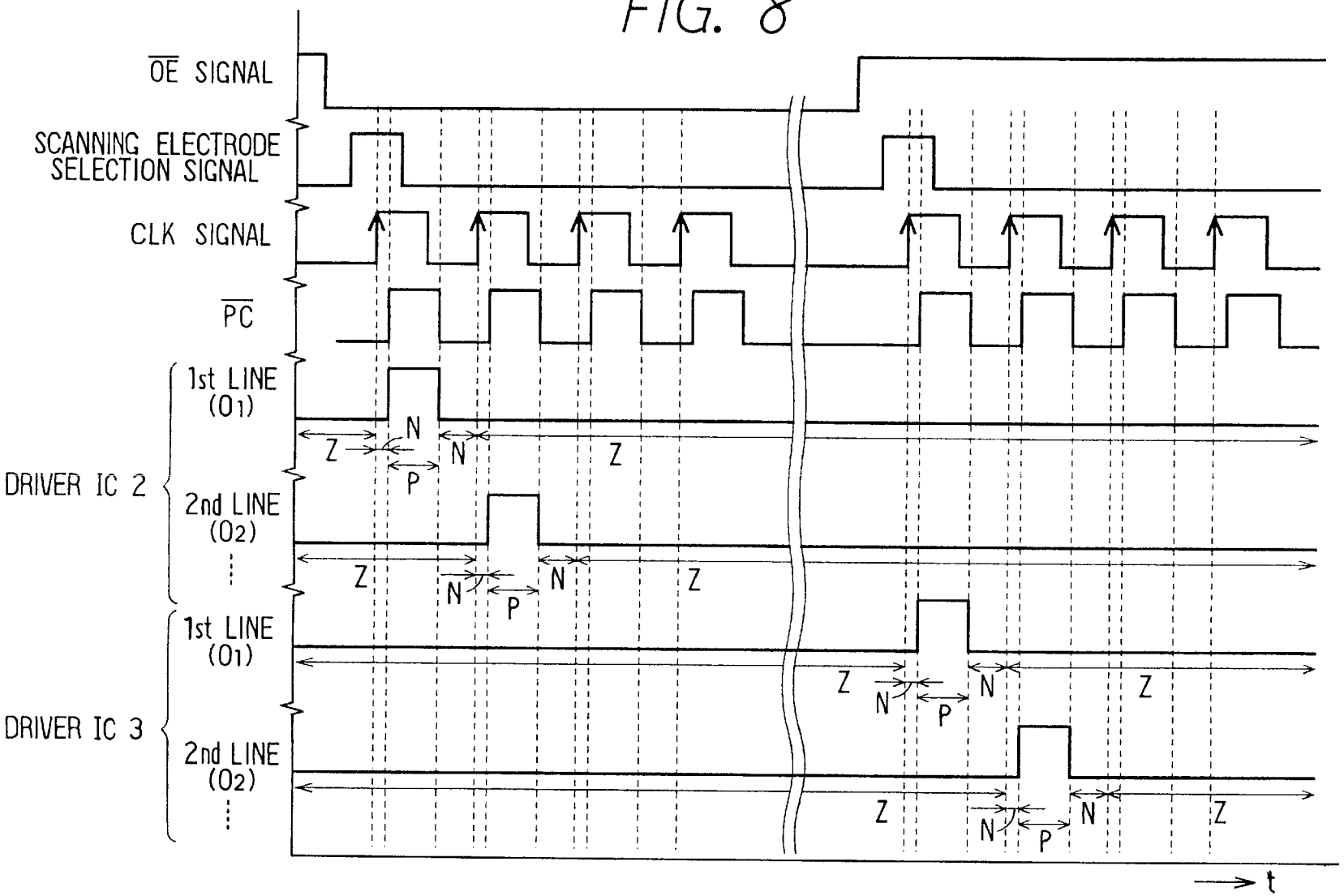
FIG. 8 is a timing chart showing various signals of the first embodiment.

In the timing chart of FIG. 8, "Z" denotes a period of high impedance, "P" denotes a period in which the P channel FET 21 is turned on and the pixels are charged, and "N" denotes a period in which the N channel FET 22 is turned on and the pixels are discharged. Thus, the scanning electrodes are scanned alternately by the driver IC 2 and the driver IC 3.

Though the scanning operation is performed in the order of the first field (FIG. 2)→the second field (FIG. 3) →the third field (FIG. 4)→the fourth field (FIG. 5), it may be changed to the order of the first field→the fourth field →the third field→the second field. The reason for scanning the scanning electrodes alternately with positive and negative voltages is to eliminate a possible luminance difference between the positive and negative fields. If the luminance difference is negligible, the scanning may be performed by repeating only the first and fourth fields. In this case, the driver IC 2 can be composed of only the P channel FETs 21 and the driver IC 3 can be composed of only the N channel FETs 22. Accordingly, the structure of the driver ICs can be simplified. Further, the scanning may be performed by repeating only the second field and the third fields.

It is also possible to use only one driver IC for scanning the electrodes. In this case, the output of the single driver IC is switched to supply the scanning voltages alternately to both sides of the scanning electrodes 11. Though the scanning voltages are supplied alternately from both sides of the scanning electrodes 11 in the embodiment described above, the data voltages may be supplied alternately from both sides of the data electrodes 12. Alternatively, both of the scanning and data voltages may be supplied alternately from both sides of the respective electrodes.

Figure 9:
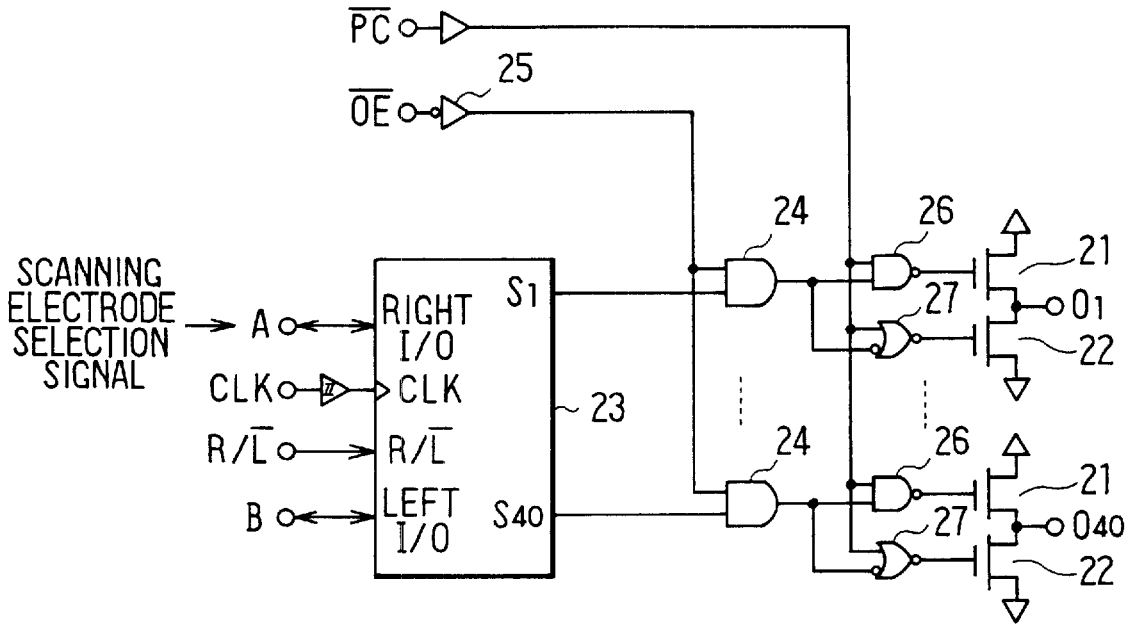
FIG. 9 is a block diagram showing a structure of a scanning electrode driving circuit used in a second embodiment of the present invention.

A second embodiment of the present invention will be described, referring to FIGS. 9 and 10. The structure of the EL display device of the second embodiment is the same as that of the first embodiment, but the scanning operation is performed in a different manner. A driver IC (which is basically the same as that of the first embodiment) used in the second embodiment is shown in FIG. 9. Outputs from terminals S1–S40 are fed to one terminal of an AND date 24. The $\overline{OE}$ signal inverted by an inverter 25 is fed to the other terminal of the AND gate 24. The $\overline{OE}$ signal is used as a control signal, in this embodiment, to turn off the P channel FET 21 and the N channel FET 22 and thereby to make the output O (O1, O2 . . . ) a high impedance state. An output from the AND gate 24 is fed to one input terminal of a NAND gate 26 and a NOR gate 27, while the $\overline{PC}$ signal is fed to the other input terminal thereof. The $\overline{PC}$ signal is used as a signal to select either the P channel FET 21 or the N channel FET 22.

The driver IC shown in FIG. 9 is connected to the left side of the scanning electrodes 11 to be used as the driver IC 2, and another driver IC having the same structure is connected to the right side of the scanning electrodes 11 to be used as the driver IC 3. The scanning operation in the second embodiment will be described, referring to FIG. 10. The sanning electrode selection pulse signal, the clock signal CLK, the $\overline{PC}$ signal and the $\overline{OE}$ signal having respective waveforms shown in FIG. 10 are supplied from an outside circuit (not shown).

When the scanning electrode selection pulse signal is fed to the shift register 23, a high level signal is sequentially delivered from the terminals S1–S40 in synchronism with a rising edge of the CLK signal. The high level signal delivered from the respective terminals is maintained until the next rising edge of the CLK signal. During a predetermined period T1 from the rising edge of the CLK signal and a predetermined period T2 from the falling edge of the CLK signal, the $\overline{OE}$ signal becomes a high level. During a period in which the $\overline{OE}$ signal is a high level, the AND gate 24 closes and its output becomes a low level. Accordingly, the output of the NAND gate 26 becomes a high level, the output of the NOR gate 27 becomes a low level, and both P channel and N channel FETs are turned off, thereby making the output O a high impedance state.

Because the NAND gate 26 is open when the $\overline{OE}$ signal is a low level, the AND gate 24 which is connected to a terminal (one of the terminals S1–S40) delivering a high level signal outputs a high level signal. Both outputs from the NAND gate 26 and the NOR gate 27 to which the high level signal is supplied become a low level when the $\overline{PC}$ signal is a high level, while both outputs become a high level when the $\overline{PC}$ signal is a low level. When both outputs from the NAND gate 26 and the NOR gate 27 are a low level, the P channel FET 21 turns on and the N channel FET 22 turns off, and thereby the output terminal O delivers a high level voltage. On the other hand, when both outputs from the NAND gate 26 and the NOR gate 27 are a high level, the P channel FET 21 turns off and the N channel FET 22 turns on, and thereby the output terminal O delivers a low level voltage.

Figure 10:
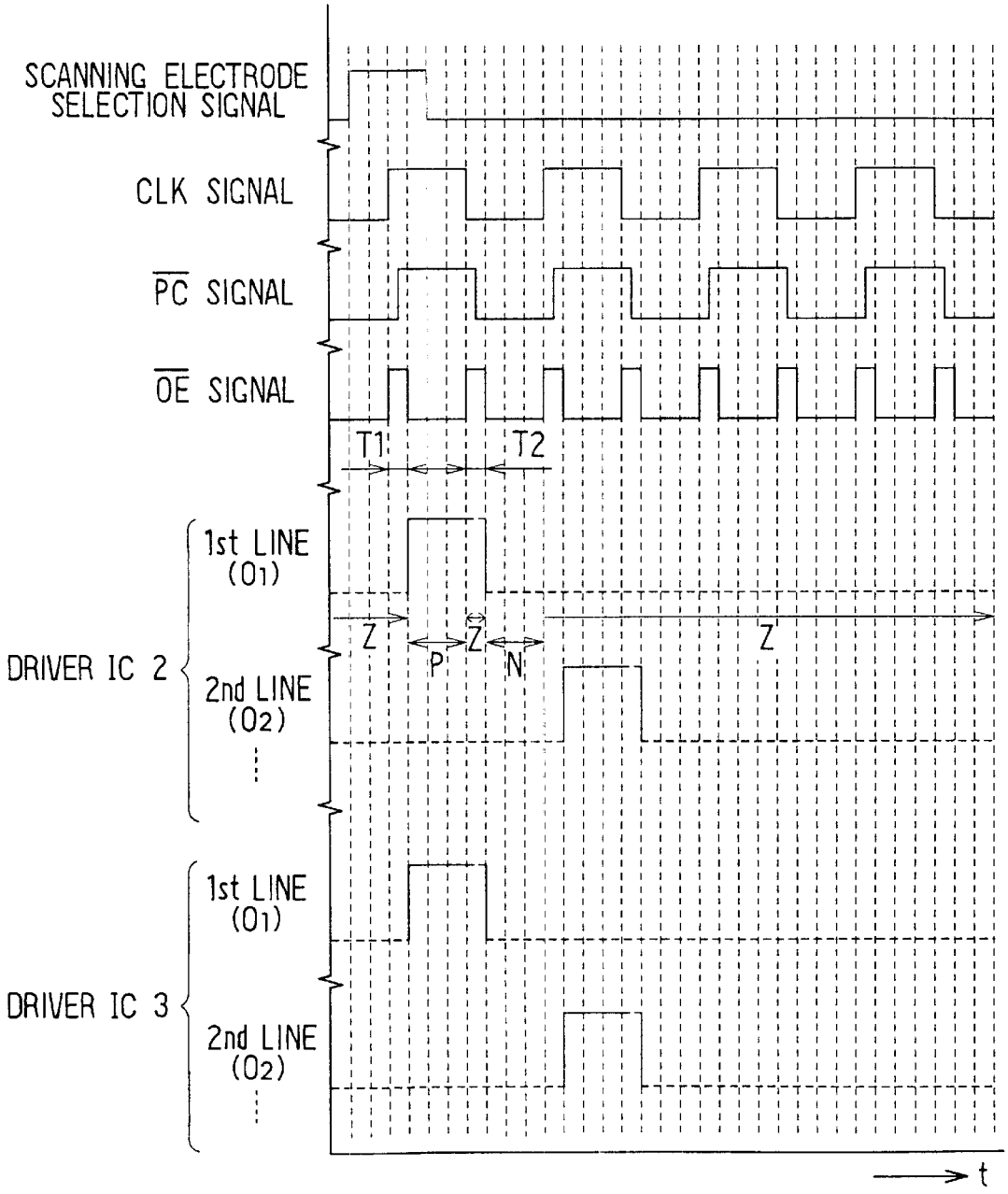
FIG. 10 is a timing chart showing various signals of the second embodiment.

In FIG. 10, "z" indicates a high impedance period, "P" indicates an ON-period of the P channel FET 21, and "N" indicates an ON-period of the N channel FET 22. Though FIG. 10 shows the operation in the positive field, the operation in the negative field is performed in the same manner, except that the levels (H and L) of the $\overline{PC}$ signal are reversed. In the manner described above, the scanning pulse voltages (O1, O2 . . . ) shown in FIG. 10 are sequentially supplied to the scanning electrodes from both driver ICs 2 and 3. Since the scanning pulse voltages are supplied to each scanning electrode 11 simultaneously from both sides, the deformation of the pulse waveform due to the electric resistance of the scanning electrode is alleviated. As a result, a luminance unevenness across both sides of the EL panel is substantially eliminated.

In the second embodiment described above, the scanning pulse voltages supplied from both sides are in the same phase (rising and falling edges of both pulse voltages appear at a matched timing), because the output O becomes a high impedance state in the periods before and after the scanning pulse voltage is supplied. Therefore, the scanning voltages can be supplied simultaneously from both sides of the scanning electrode without allowing excessive current to flow through the scanning electrode. If the phase of scanning voltages supplied from both sides are not equal, there is a chance to allow excessive current to flow and to cause a short-circuit between both driver ICs. The scanning operation of the second embodiment is especially effective for a display device such as an EL display device which is driven by relatively high voltage and for a display device having scanning electrodes made of a low resistance metallic material.

Though two driver ICs, each connected to each side of the scanning electrode, are used in the embodiment described above, it is also possible to use one driver IC which supplies scanning voltages simultaneously to both sides. Though the simultaneous scanning is applied to the scanning electrodes in the embodiment, it may be applied to the data electrodes in case the waveform deformation in the data electrodes causes the problem of uneven luminance. This invention may be also applied to a liquid crystal display device having a matrix electrode structure.

While the present invention has been shown and described with reference to the foregoing preferred embodiments, it will be apparent to those skilled in the art that changes in form and detail may be made therein without departing from the scope of the invention as defined in the appended claims.

What is claimed is:

1. An electroluminescent display device comprising:

a display panel having a plurality of scanning electrodes, a plurality of data electrodes and an electroluminescent layer interposed between both electrodes, both of the scanning and data electrodes forming a matrix;

means for driving the scanning electrodes by applying a scanning voltage thereto, the means including a first scanning electrode driver connected to one side of the scanning electrodes and a second scanning electrode driver connected to the other side of the scanning electrodes; and means for driving the data electrodes by applying a data voltage thereto; wherein:

the scanning electrodes are transparent electrodes;

the scanning voltage is applied to the transparent scanning electrodes by sequentially scanning the transparent scanning electrodes from one of the first scanning electrode driver and the second scanning electrode driver while maintaining the other of the first scanning electrode driver and the second scanning electrode driver inoperative;

the scanning electrodes are scanned by repeating a series of fields consisting of a first field, a second field, a third field, and a fourth field;

a positive scanning voltage is sequentially applied to the scanning electrodes from the first scanning electrode driver in the first field, while maintaining the second scanning electrode driver inoperative by increasing its impedance to a higher level;

a negative scanning voltage is sequentially applied to the scanning electrodes from the first scanning electrode driver in the second field, while maintaining the second scanning electrode driver inoperative by increasing its impedance to a higher level;

a positive scanning voltage is sequentially applied to the scanning electrodes from the second scanning electrode driver in the third field, while maintaining the first scanning electrode driver inoperative by increasing its impedance to a higher level; and a negative scanning voltage is sequentially applied to the scanning electrodes from the second scanning electrode driver in the fourth field, while maintaining the first scanning electrode driver inoperative by increasing its impedance to a higher level.

* * * * *